US012800234B2

(12) United States Patent
Wong

(10) Patent No.: US 12,800,234 B2
(45) Date of Patent: Nov. 17, 2026

(54) ALUMINUM VAPOR CHAMBER DEVICE

(71) Applicant: National Tsing Hua University, Hsinchu City (TW)

(72) Inventor: Shwin-Chung Wong, Hsinchu City (TW)

(73) Assignee: National Tsing Hua Univeristy, Hsinchu City (TW)

( * ) Notice: Subject to any disclaimer, the term of this patent is extended or adjusted under 35 U.S.C. 154(b) by 245 days.

(21) Appl. No.: 18/945,555

(22) Filed: Nov. 13, 2024

(65) Prior Publication Data

US 2026/0110496 A1 Apr. 23, 2026

(30) Foreign Application Priority Data

Oct. 21, 2024 (TW) ..... 113139912

(51) Int. Cl.
*F28D 15/02* (2006.01)

(52) U.S. Cl.
CPC ..... *F28D 15/0233* (2013.01)

(58) Field of Classification Search
CPC . H05K 7/20336; F28D 15/0233; F28D 15/04; F28D 15/046
See application file for complete search history.

(56) References Cited

U.S. PATENT DOCUMENTS 12,025,382 B2 * 7/2024 Wang ..... F28D 15/046
2011/0108142 A1 * 5/2011 Liu ..... H10W 40/73 137/561 R
2022/0354019 A1 * 11/2022 Tsai ..... F28D 15/0233
2023/0019481 A1 1/2023 Jin et al.
2024/0206120 A1 6/2024 Ham et al.
2024/0310126 A1 * 9/2024 Liu ..... F28D 15/0266
2025/0052511 A1 * 2/2025 Lin ..... F28D 15/0233

FOREIGN PATENT DOCUMENTS

CN 102778157 11/2012
CN 103722345 4/2014
CN 106604621 4/2019
(Continued)

OTHER PUBLICATIONS

"Notice of allowance of Taiwan Counterpart Application", issued on Jan. 13, 2026, p. 1-p. 4.
(Continued)

*Primary Examiner* — Jon T. Schermerhorn, Jr.
(74) *Attorney, Agent, or Firm* — JCIPRNET

(57) ABSTRACT

An aluminum vapor chamber device includes a first plate, a second plate, side walls and support bars. The second plate is located above the first plate. The side walls are connected to the first plate and the second plate, and an internal space is surrounded by the first plate, the second plate and the side walls. The support bars are arranged side by side in the internal space along a first direction, extend along a second direction, and connect the first plate and the second plate to divide the internal space into channels. Each of the support bars include first holes to communicate with the channels. The first plate includes first grooves located in the channels and extending along the second direction. The second plate includes second grooves located in the channels and extending along the second direction.

10 Claims, 3 Drawing Sheets

(56) References Cited

FOREIGN PATENT DOCUMENTS

| | | | | | |
|---|---|---|---|---|---|
| CN | 106604621 | B | * | 4/2019 | ..... H05K 7/20336 |
| CN | 112996339 | | | 6/2021 | |
| TW | M269435 | | | 7/2005 | |
| TW | M595784 | | | 5/2020 | |
| TW | I842472 | | | 5/2024 | |
| WO | WO-2018198353 | A1 | * | 11/2018 | ..... F28D 15/046 |

OTHER PUBLICATIONS

"Office Action of Taiwan Counterpart Application", issued on Jul. 3, 2025, p. 1-p. 6.

* cited by examiner

ALUMINUM VAPOR CHAMBER DEVICE

CROSS-REFERENCE TO RELATED APPLICATION

This application claims the priority benefit of Taiwan application serial no. 113139912, filed on Oct. 21, 2024. The entirety of the above-mentioned patent application is hereby incorporated by reference herein and made a part of this specification.

BACKGROUND

Technical Field

The present invention relates to a large-footprint aluminum vapor chamber device, and particularly relates to an aluminum vapor chamber device that has good structural strength, is adapted for small-sized heat sources, and has good heat dissipation.

Description of Related Art

Currently, vapor chambers made by aluminum extrusion method have a flat shape, and multiple support bars are set inside the vapor chamber to prevent the upper plate and the lower plate from collapsing towards each other during vacuum extraction, or to prevent expansion and deformation of the upper plate and the lower plate when residual non-condensable gases (NCG) are heated. The support bars form many separated channels inside the vapor chamber, causing the two-phase fluid to undergo phase changes only within their respective channels.

Although this type of aluminum vapor chamber has good structural strength, the channels between the support bars are sealed, and only large-sized heat sources that can span across multiple channels can utilize the two-phase fluid in each channel for heat dissipation. If the heat source size is small compared to the width of the vapor chamber and only covers some of the channels, it may not be able to fully utilize the heat dissipation capability provided by the two-phase fluid in all channels of the vapor chamber.

SUMMARY

The present invention provides an aluminum vapor chamber device that has good structural strength, is adapted for small-sized heat sources, and has good heat dissipation.

The aluminum vapor chamber device of the present invention includes a first plate, a second plate, multiple side walls, and multiple support bars. The second plate is located above the first plate. The side walls connect to the first plate and the second plate, and an internal space is surrounded by the side walls, the first plate and the second plate. The support bars are arranged in parallel along a first direction in the internal space, extend along a second direction, and connect the first plate and the second plate to divide the internal space into multiple channels. Each of the support bars includes multiple first holes to communicate with the channels. The first plate includes multiple first grooves located in the channels and extending along the second direction, and the second plate includes multiple second grooves located in the channels and extending along the second direction.

In one embodiment of the present invention, the side walls include a first side wall and a second side wall opposite to each other, and each of the support bars is connected to the first side wall and the second side wall.

In one embodiment of the present invention, the side walls include a third side wall. The third side wall is connected to the first side wall and the second side wall. The third side wall includes a liquid filling hole which is sealed and multiple second holes which are sealed. The liquid filling hole and the second holes correspond to at least some of the first holes. Each of the second holes is filled with a sealing material.

In one embodiment of the present invention, each of the second holes is a screw hole, and the sealing material is an aluminum screw or an aluminum alloy screw.

In one embodiment of the present invention, the sealing material is aluminum solder.

In another embodiment, each of the sealing material may be a section of aluminum or aluminum alloy filled by squeezing.

In one embodiment of the present invention, in each of the support bars, a distance between one of the first holes closest to the second side wall and the second side wall is smaller than a distance between the liquid filling hole and the first side wall.

In one embodiment of the present invention, the side walls include a fourth side wall opposite to the third side wall. The fourth side wall is connected to the first side wall and the second side wall. The fourth side wall includes multiple third holes which are sealed. The third holes correspond to the first holes of each of the support bars, respectively.

In one embodiment of the present invention, the side walls include a fourth side wall opposite to the third side wall. The fourth side wall is connected to the first side wall and the second side wall. The fourth side wall includes multiple third holes which are sealed. The liquid filling hole and the second holes only correspond to some of the first holes of each of the plurality of support bars, and the third holes correspond to the rest of the first holes in each of the support bars.

In one embodiment of the present invention, a distance between at least some of the first holes and the first plate is smaller than a distance between the at least some of the first holes and the second plate.

Based on the above, in the vapor chamber device of the present invention, the second plate is located above the first plate, the side walls connect to the first plate and the second plate, and an internal space is surrounded by the plurality of side walls, the first plate and the second plate. The support bars are arranged in parallel along the first direction in the internal space, extend along the second direction, and connect the first plate and the second plate to divide the internal space into multiple channels. The support bars may provide the vapor chamber device of the present invention with good structural strength. Moreover, the first holes in each of the support bars allow the channels to communicate with each other. Therefore, the two-phase fluid located in the internal space may flow in the channels. Even when the heat source size is small and the vapor chamber width is so large that the heat source does not cover the range of all channels, the steam in the channel corresponding to the heat source may also flow to other channels for heat exchange. Compared to the known sealed channel vapor chamber which cannot utilize all channels for heat exchange when using a small-sized heat source, the vapor chamber device of the present invention may fully utilize the entire internal space for phase change, thus providing better heat dissipation effect.

DESCRIPTION OF THE EMBODIMENTS

Figure 1:
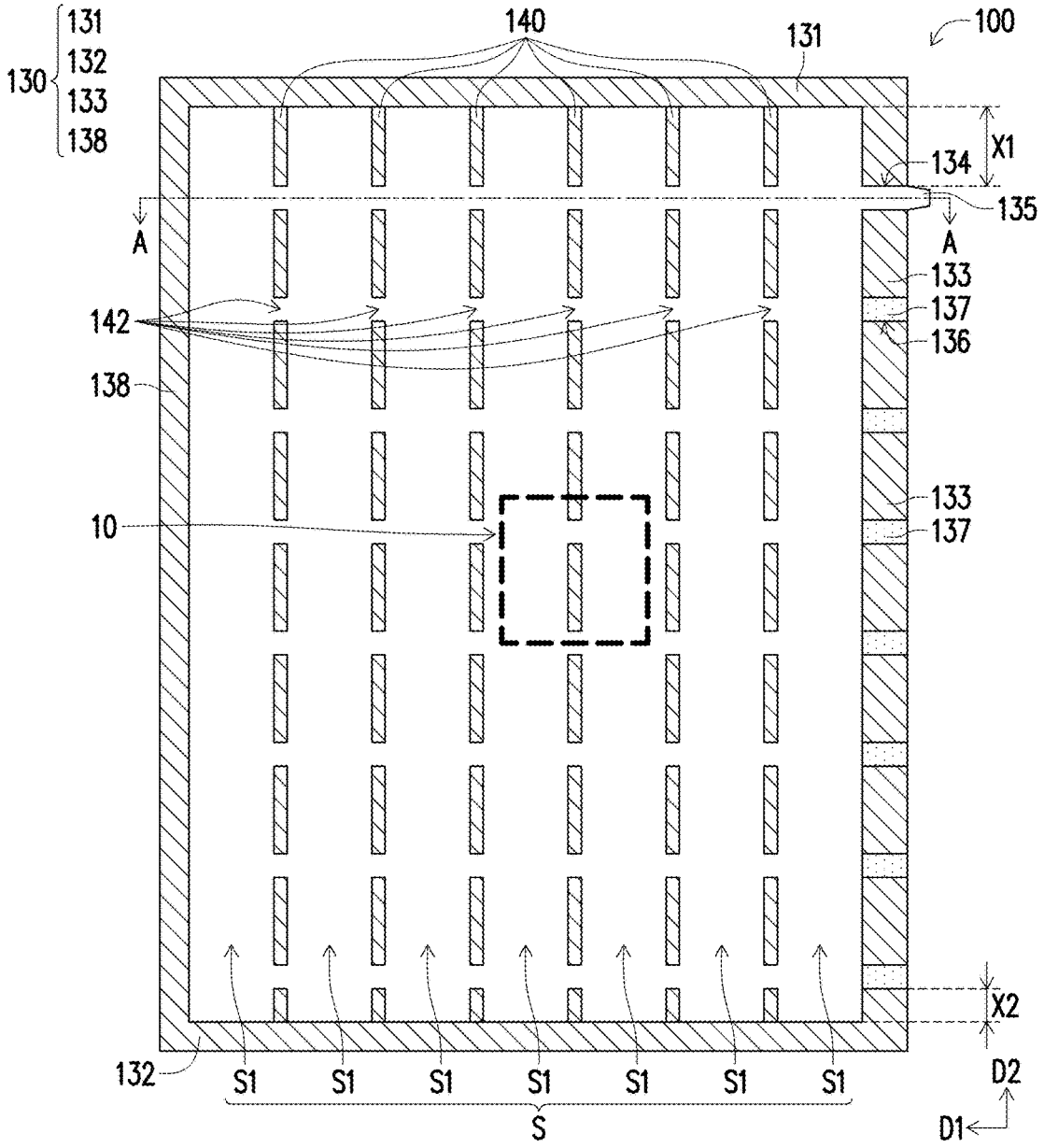
FIG. 1 is an internal top view illustrating a vapor chamber device according to one embodiment of the present invention.
Figure 2:
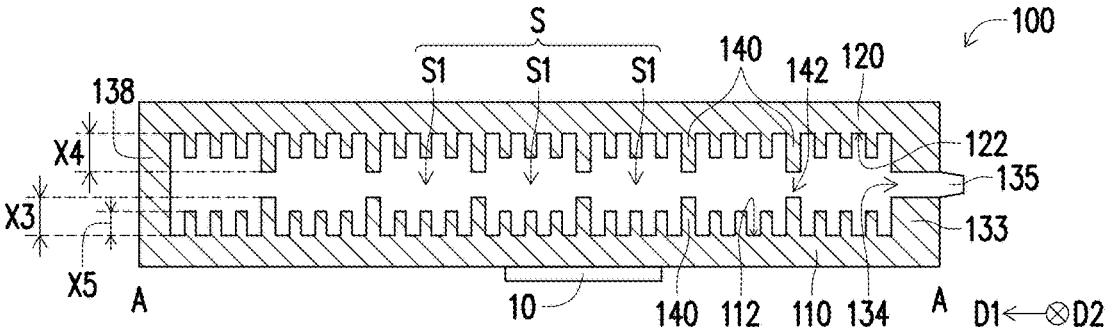
FIG. 2 is a cross-sectional view illustrating the vapor chamber device of FIG. 1 along the line segment A-A.

FIG. 1 is an internal top view illustrating a vapor chamber device according to one embodiment of the present invention. FIG. 2 is a cross-sectional view illustrating the vapor chamber device of FIG. 1 along the line segment A-A. It is noted that, in order to concisely shown the interior of the vapor chamber device in FIG. 1, the second plate, the first groove, and the second groove of FIG. 2 are hidden in FIG. 1.

Refer to FIG. 1 and FIG. 2, the appearance shape of the aluminum vapor chamber device 100 in this embodiment is, for instance, a rectangular plate shape, but the appearance shape of the aluminum vapor chamber device 100 may be any shape and is not limited to the illustrated shape.

The aluminum vapor chamber device 100 is adapted for thermal coupling to a heat source 10. The heat source 10 is, for example, a central processing unit of a motherboard, but the heat source 10 may also be other chips. The type and number of the heat sources 10 are not limited thereto. As shown in FIG. 1 and FIG. 2, the dimension of the heat source 10 is approximately between ⅓ to 1/10 times the width of the aluminum vapor chamber device 100. Of course, the dimension of the heat source 10 is not limited to this.

The aluminum vapor chamber device 100 of this embodiment includes a first plate 110 (FIG. 2), a second plate 120 (FIG. 2), multiple side walls 130 (FIG. 1), and multiple support bars 140. The second plate 120 is located above the first plate 110. The side walls 130 are connected to the first plate 110 and the second plate 120, and an internal space S is surrounded by the side walls 130, the first plate 110 and the second plate 120. The heat source 10 is adapted for contacting an outer surface of the first plate 110, thereby transferring the heat generated by the heat source 10 to the aluminum vapor chamber device 100.

In this embodiment, the material of the first plate 110, the second plate 120, the side walls 130, and the support bars 140 is metal, for instance, aluminum or aluminum alloy, but is not limited to this.

The side walls 130 include a first side wall 131 and a second side wall 132 opposite to each other, as well as a third side wall 133 and a fourth side wall 138 opposite to each other. The third side wall 133 is connected to the first side wall 131 and the second side wall 132, and the fourth side wall 138 is connected to the first side wall 131 and the second side wall 132. In this embodiment, the first side wall 131 and the second side wall 132 are the short edges of the rectangle, while the third side wall 133 and the fourth side wall 138 are the long edges of the rectangle, but the arrangement is not limited thereto.

It is noted that, in this embodiment, the first side wall 131 and the second side wall 132 are formed by pinching to seal the edges. The third side wall 133 and the fourth side wall 138 are directly formed during aluminum extrusion. Of course, the methods of forming the side walls 130 are not limited thereto. Therefore, any one of the side walls 130 is not necessarily a single piece plate and perpendicular to the first plate 110 and the second plate 120, but may be formed by pinching two pieces together.

The support bars 140 are arranged in parallel along a first direction D1 in the internal space S, extend along a second direction D2, and connected the first plate 110 and the second plate 120, thereby dividing the internal space S into multiple channels S1.

The channels S1 will be vacuumed and filled with a two-phase fluid. The two-phase fluid is, for example, acetone compatible with aluminum containers, but the type of two-phase fluid is not limited thereto, as long as it can be compatible with the material of the aluminum vapor chamber device 100. The two-phase fluid may, for example, flow in the channels S1 in liquid form.

Although each of the support bars 140 in FIG. 1 and FIG. 2 appears visually similar to multiple disconnected parts due to the viewing angle, in reality, each of the support bars 140 is a continuous strip-shaped plate that is connected vertically to the first plate 110 and the second plate 120, and is connected horizontally to the first side wall 131 and the second side wall 132. This configuration provides good structural strength and offers excellent support for the aluminum vapor chamber device 100.

Moreover, in this embodiment, each of the support bars 140 includes multiple first holes 142, allowing the channels S1 to communicate with each other. Therefore, the two-phase fluid located in the internal space S can flow through the channels S1. Even when the heat source 10 is small and does not cover the range of all channels S1, the steam in the channels S1 corresponding to the heat source 10 can flow through the first holes 142 to other channels S1 for heat exchange. Compared to known sealed-channel aluminum vapor chambers that cannot utilize all channels for heat exchange when using a small-sized heat source or a relatively large vapor chamber width, the aluminum vapor chamber device 100 of the embodiment can fully utilize the entire internal space S for phase change, thus providing better heat dissipation effect.

In addition, as shown in FIG. 1, the third side wall 133 includes a liquid filling hole 134 which is sealed and multiple second holes 136 which are sealed, with the liquid filling hole 134 and the second holes 136 corresponding to at least some of the first holes 142. In this embodiment, the liquid filling hole 134 and the second holes 136 correspond to the first holes 142 of each of the support bars 140, respectively. Each of the second holes 136 is filled with a sealing material 137.

In one embodiment, the sealing material 137 may be aluminum solder, such as aluminum or aluminum alloy, to have the same or similar expansion coefficient as the third side wall 133, but it is not limited thereto. In another embodiment, each of the sealing material 137 may be a section of aluminum or aluminum alloy filled by squeezing. In another embodiment, each of the second holes 136 may be a screw hole, and the sealing material 137 may be an aluminum screw or an aluminum alloy screw.

In one embodiment, a thickness of the third side wall 133 may be greater to form screw holes. In one embodiment, the thickness of the third side wall 133 may be greater than a thickness of the fourth side wall 138.

The aluminum vapor chamber device 100 of this embodiment may be manufactured using an aluminum extrusion process to form the first plate 110, second plate 120 which are spaced-apart, the side walls 130, and the support bars 140. Then, holes are drilled from the third side wall 133 towards the interior of the aluminum vapor chamber device 100 to form the liquid filling hole 134, the second holes 136, and the first holes 142 on the support bars 140.

In one embodiment, an aluminum extrusion process may also be used to manufacture the upper and lower plates which are spaced-apart, the third side wall 133, the fourth side wall 138, and the support bars 140, and holes are drilled from the third side wall 133 towards the interior of the aluminum vapor chamber device 100 to form the second holes 136 and the first holes 142 on the support bars 140. Then, the first side wall 131 and the second side wall 132 are formed by pinching to seal the edges, leaving only the liquid filling hole 134 unsealed. Of course, the manufacturing method is not limited thereto.

Next, the second holes 136 of the third side wall 133 are sealed with the sealing material 137, and a filling tube (not shown) is welded to the liquid filling hole 134. Then, the internal space S of the aluminum vapor chamber device 100 is evacuated through the filling tube and the liquid filling hole 134.

Since the channels within the current commercial vapor chamber are separated from each other, to fill each individual channel with a same amount of working fluid is more tedious. Specifically, it is challenging to completely remove the non-condensable gases (NCG) from each channel, resulting in excessive residual non-condensable gases within the vapor chamber, which leads to lower thermal performance of the vapor chamber.

In this embodiment, the channels S1 of the aluminum vapor chamber device 100 are communicated with the first holes 142, therefore, a single liquid filling hole 134 can quickly and simply remove the non-condensable gases (NCG) from each channel S1. Moreover, the support bars 140 can provide stable support for the first plate 110 and the second plate 120 during this process.

After evacuating the internal space S of the aluminum vapor chamber device 100, the two-phase fluid is injected into the internal space S through the liquid filling hole 134. Since the channels S1 of the aluminum vapor chamber device 100 are communicated with the first holes 142, the two-phase fluid can easily and evenly flow into all channels S1, so that a single filling suffices.

As shown in FIG. 1, in this embodiment, the liquid filling hole 134 is closer to the first side wall 131 than the second holes 136. In each of the support bars 140, a distance X2 between one of the first holes 142 which is closest to the second side wall 132 and the second side wall 132 is smaller than a distance X1 between the liquid filling hole 134 and the first side wall 131.

This design allows manufacturers to easily fill the aluminum vapor chamber device 100 with the two-phase fluid by simply standing the aluminum vapor chamber device 100 upright during the liquid filling process. The two-phase fluid is injected from the liquid filling hole 134 and flows downward towards the second side wall 132. Due to the distance X2 is smaller, the two-phase fluid can quickly overflow from the lowermost first hole 142 to other channels S1, enabling faster entry of the two-phase fluid into each channel S1.

After filling with the two-phase fluid, due to the high ductility of aluminum, the filling tube may be sealed by pinching (clamping and cutting off), forming a sealed tube 135, thus completing the manufacturing of the aluminum vapor chamber device 100. This manufacturing method has advantages such as low manufacturing cost and light weight. In this embodiment, the sealed tube 135 protrudes from the third side wall 133. However, in other embodiments, the sealed tube 135 may also be flattened to be flush with the third side wall 133. In one embodiment, the sealing of the liquid filling hole 134 may be inclined to the third side wall 133.

Moreover, as shown in FIG. 2, in this embodiment, in each of the support bars 140, a distance X3 between the first holes 142 and the first plate 110 is equal to a distance X4 between the first holes 142 and the second plate 120. In other words, the first holes 142 are located at a central position of the support bars 140 in terms of height.

It is worth mentioning that, in this embodiment, the first plate 110 includes multiple first grooves 112 located within the channels S1 and extending along the second direction D2, and the second plate 120 includes multiple second grooves 122 located within the channels S1 and extending along the second direction D2. The first grooves 112 and the second grooves 122 may serve as capillary structures to enhance the fluidity of the fluid.

Specifically, the area of the aluminum vapor chamber device 100 corresponding to the heat source 10 (the area projected by the heat source 10) is called the evaporation area, and the area outside the projection of the heat source 10 is called the condensation area. The steam evaporated in the evaporation area condenses into liquid in the condensation area, and then flows back to the evaporation area to complete the evaporation cycle. The first grooves 112 and the second grooves 122 may allow the liquid in the condensation area to flow back to the evaporation area more easily, thereby enhancing heat dissipation.

Furthermore, in each of the support bars 140, the distance X3 between the first holes 142 and the first plate 110 is greater than a height X5 by which the first grooves 112 protrude from the first plate 110.

Figure 3:
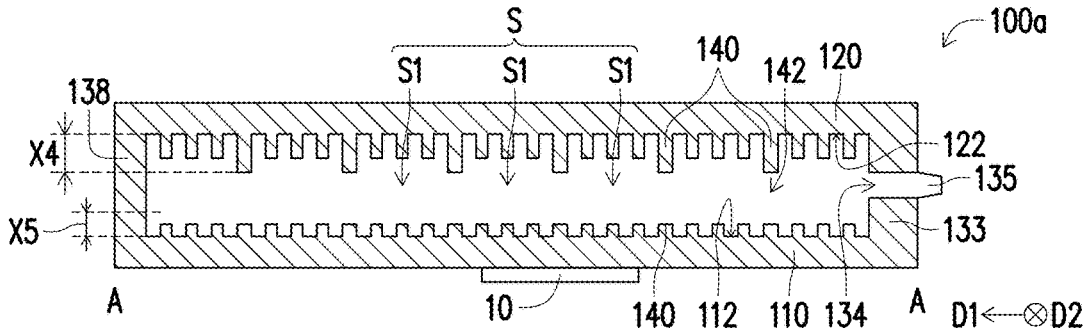
FIG. 3 is a cross-sectional view illustrating a vapor chamber device according to another embodiment of the present invention.

FIG. 3 is a cross-sectional illustrative view of a vapor chamber device according to another embodiment of the present invention. Referring to FIG. 3, the main difference between the aluminum vapor chamber device 100*a* in FIG. 3 and the aluminum vapor chamber device 100 in FIG. 2 is that, in this embodiment, in at least one of the support bars 140, the distance between the first holes 142 and the first plate 110 is equal to the height X5 by which multiple first grooves 112 protrude from the first plate 110. Moreover, the distance between the first holes 142 and the first plate 110 (i.e., height X5) is less than the distance X4 between the first holes 142 and the second plate 120. In this embodiment, each of the support bars 140 has the aforementioned design, but this is not limited thereto.

In other words, the first holes 142 are located at the lower-middle position of the support bars 140 in terms of height. This design may allow the liquid between the channels S1 to move horizontally more conveniently. Because the first holes 142 are positioned lower in height, the liquid in the condensation area may flow back horizontally to the evaporation area more easily, thereby enhancing heat dissipation.

In one embodiment, it may also be that only the distance (i.e., height X5) between the first holes 142 corresponding to the evaporation area and the first plate 110 is less than the distance X4 between the first holes 142 corresponding to the evaporation area and the second plate 120, it is not limited to FIG. 3.

Figure 4:
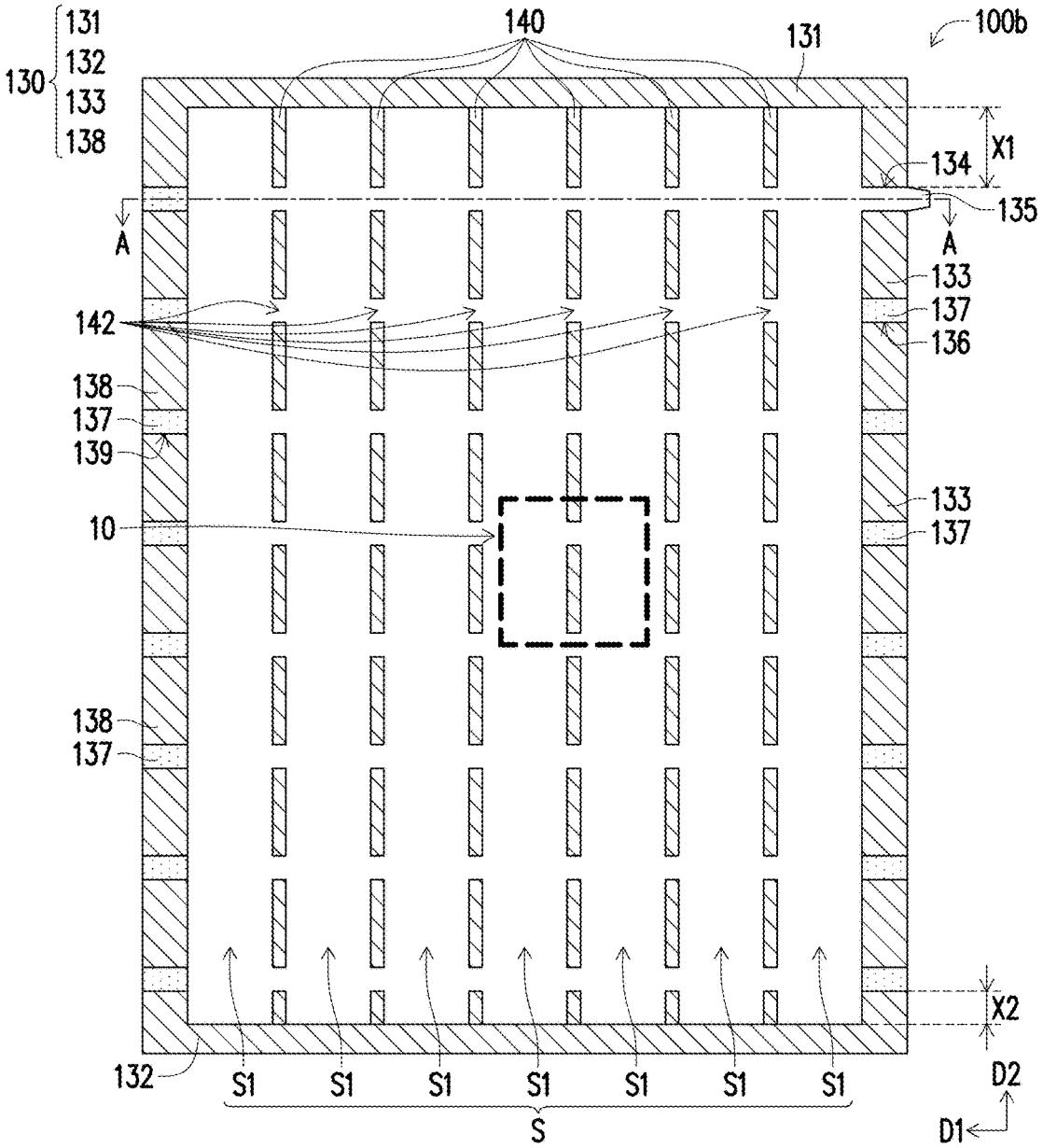
FIG. 4 is an internal top view illustrating a vapor chamber device according to another embodiment of the present invention.

FIG. 4 is a top view illustrative diagram of the interior of a vapor chamber device according to another embodiment of the present invention. Referring to FIG. 4, the main difference between the aluminum vapor chamber device 100*b* in FIG. 4 and the aluminum vapor chamber device 100 in FIG. 1 is that, in this embodiment, the fourth side wall 138 includes multiple third holes 139 which are sealed, the third holes 139 correspond to the first holes 142 of each of the support bars 140.

In other words, the topmost third hole 139 of the fourth side wall 138 aligns with the topmost first hole 142 of the support bar 140 and the liquid filling hole 134 of the third side wall 133, the second third hole 139 from top to bottom of the fourth side wall 138 aligns with the second first hole 142 of the support bar 140 and the first second hole 136 of the third side wall 133, and so on.

When the width of the aluminum vapor chamber device 100*b* is relatively large, if the first holes 142 are drilled only from the third side wall 133, the length of the drill bit may not be sufficient. In this case, the holes may be formed by drilling inward separately from the third side wall 133 and the fourth side wall 138. In other words, the manufacturer may drill the second holes 136 and a portion of the first holes 142 of the support bars 140 inward from the third side wall 133, and drill the third holes 139 and another portion of the first holes 142 of the support bars 140 inward from the fourth side wall 138. Afterwards, the second holes 136 and third holes 139 may be sealed by filling them with the sealing material 137.

In one embodiment, the sealing material 137 may be solder, such as aluminum or aluminum alloy, to have the same or similar expansion coefficient as the fourth side wall 138, but it is not limited thereto. In another embodiment, each of the third holes 139 may be a screw hole, and the sealing material 137 may be an aluminum screw or aluminum alloy screw. In another embodiment, each of the sealing material 137 may be a section of aluminum or aluminum alloy filled by squeezing. In one embodiment, the thickness of the fourth side wall 138 may be greater than the thickness of the first side wall 131, to ensure that the fourth side wall 138 has sufficient thickness to form screw holes.

Figure 5:
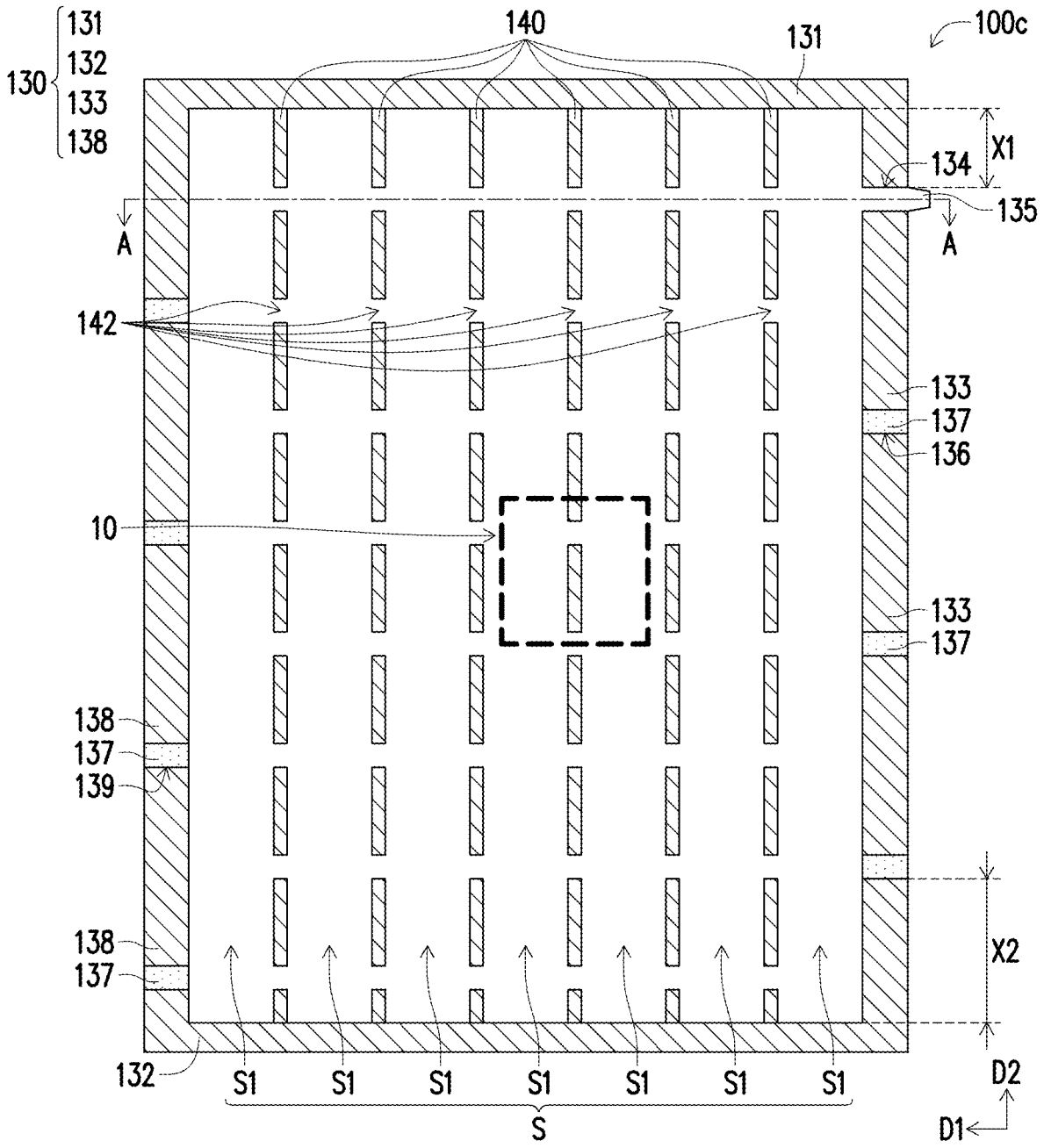
FIG. 5 is an internal top view illustrating a vapor chamber device according to another embodiment of the present invention.

FIG. 5 is a top view illustrative diagram of the interior of a vapor chamber device according to another embodiment of the present invention. Referring to FIG. 5, the main difference between the aluminum vapor chamber device 100*c* in FIG. 5 and the aluminum vapor chamber device 100*b* in FIG. 4 is that, in this embodiment, the liquid filling hole 134 and the second holes 136 of the third side wall 133 correspond to only some of the first holes 142 of each of the support bars 140, while the third holes 139 of the fourth side wall 138 correspond to the rest of the first holes 142 of each of the support bars 140.

In this embodiment, the manufacturer may drill the second holes 136 and a portion of the first holes 142 of the support bars 140 inward from the third side wall 133, and drill the third holes 139 and another portion of the first holes 142 of the support bars 140 inward from the fourth side wall 138.

In summary, the vapor chamber device of the present invention has the second plate located above the first plate, the side walls connect to the first plate and the second plate, and an internal space is surrounded by the plurality of side walls, the first plate and the second plate. The support bars are arranged in parallel along the first direction in the internal space, extend along the second direction, and connect the first plate and the second plate to divide the internal space into multiple channels. The support bars may provide the vapor chamber device of the present invention with good structural strength. Moreover, the first holes of each of the support bars allow the channels to communicate with each other. Therefore, the two-phase fluid in the internal space may flow in the channels. Even when the heat source size is small and the vapor chamber width is so large that the heat source does not cover the range of all channels, the steam in the channels corresponding to the heat source may also flow to other channels for heat exchange. Compared to the commercial sealed-channel vapor chambers that cannot utilize all channels for heat exchange when using a small-sized heat source, the vapor chamber device of the present invention may fully utilize the entire internal space for phase change, thus providing better heat dissipation effect.

What is claimed is:

1. An aluminum vapor chamber device, comprising:

a first plate;

a second plate, located above the first plate;

a plurality of side walls, connected to the first plate and the second plate, wherein an internal space is surrounded by the plurality of side walls, the first plate and the second plate; and a plurality of support bars, arranged in parallel along a first direction in the internal space, extending along a second direction, and connected to the first plate and the second plate, to divide the internal space into a plurality of channels, wherein each of the plurality of support bars comprises a plurality of first holes communicated with the plurality of channels, the first plate comprises a plurality of first grooves located within the plurality of channels and extending along the second direction, the second plate comprises a plurality of second grooves located within the plurality of channels and extending along the second direction.

2. The aluminum vapor chamber device as claimed in claim 1, wherein the plurality of side walls comprise a first side wall and a second side wall opposite to each other, each of the plurality of support bars is connected to the first side wall and the second side wall.

3. The aluminum vapor chamber device as claimed in claim 2, wherein the plurality of side walls comprise a third side wall, the third side wall is connected to the first side wall and the second side wall, the third side wall comprises a liquid filling hole which is sealed and a plurality of second holes which are sealed, the liquid filling hole and the plurality of second holes correspond to at least some of the plurality of first holes of each of the plurality of support bars, each of the plurality of second holes is filled with a sealing material.

4. The aluminum vapor chamber device as claimed in claim 3, wherein each of the plurality of second holes is a screw hole, the sealing material is an aluminum screw or an aluminum alloy screw.

5. The aluminum vapor chamber device as claimed in claim 3, wherein the sealing material is aluminum solder.

6. The aluminum vapor chamber device as claimed in claim 3, wherein the sealing material is a section of aluminum or aluminum alloy filled by squeezing.

7. The aluminum vapor chamber device as claimed in claim 3, wherein in each of the plurality of support bars, a distance between one of the plurality of first holes of each of the plurality of support bars which is closest to the second side wall and the second side wall is smaller than a distance between the liquid filling hole and the first side wall.

8. The aluminum vapor chamber device as claimed in claim 3, wherein the plurality of side walls comprise a fourth side wall opposite to the third side wall, the fourth side wall is connected to the first side wall and the second side wall, the fourth side wall comprises a plurality of third holes which are sealed, the plurality of third holes correspond to the plurality of first holes of each of the plurality of support bars, respectively.

9. The aluminum vapor chamber device as claimed in claim 3, wherein the plurality of side walls comprise a fourth side wall opposite to the third side wall, the fourth side wall is connected to the first side wall and the second side wall, the fourth side wall comprises a plurality of third holes which are sealed, the liquid filling hole and the plurality of second holes only correspond to the some of the plurality of first holes of each of the plurality of support bars, the plurality of third holes correspond to the rest of the plurality of first holes of each of the plurality of support bars.

10. The aluminum vapor chamber device as claimed in claim 1, wherein a distance between at least some of the plurality of first holes and the first plate is smaller than a distance between the at least some of the plurality of first holes and the second plate.

* * * * *